United States Patent [19]

Tanaka et al.

[11] Patent Number: 4,737,818

[45] Date of Patent: Apr. 12, 1988

[54] TONER IMAGE FIXING DEVICE

[75] Inventors: Kenzo Tanaka, Kadoma; Tadashi Ohira, Toyokawa, both of Japan

[73] Assignee: Minolta Camera Kabushiki Kaisha, Osaka, Japan

[21] Appl. No.: 51,139

[22] Filed: May 18, 1987

[30] Foreign Application Priority Data

May 28, 1986 [JP] Japan ..... 61-121287

[51] Int. Cl.[4] ..... G03G 15/00

[52] U.S. Cl. ..... 355/14 FU; 355/3 FU; 219/216

[58] Field of Search ..... 355/3 AU, 14 FU, 3 R, 355/14 R; 219/216, 388, 389; 432/60

[56] References Cited

U.S. PATENT DOCUMENTS

| | | | |
|---|---|---|---|
| 4,385,826 | 5/1983 | Itoh | 355/14 FU |
| 4,556,779 | 12/1985 | Hashimoto et al. | 219/216 |
| 4,595,274 | 6/1986 | Sakurai | 355/14 FU X |
| 4,609,278 | 9/1986 | Taniguchi | 355/3 FU |

*Primary Examiner*—A. C. Prescott

*Attorney, Agent, or Firm*—Burns, Doane, Swecker & Mathis

[57] ABSTRACT

A toner image fixing device to be incorporated into an electrophotographic copying machine or the like, comprises fixing rollers internally provided with heating means, temperature detecting means for detecting the respective surface temperatures of the fixing rollers, and control means which controls the fixing rollers for preliminary rotation prior to copying operation on the basis of the surface temperature difference between the fixing rollers and a predetermined value. In starting up the electrophotographic copying machine, the preliminary rotation of the fixing rollers is started after the temperature difference between the fixing rollers has reached to a predetermined value to enable heat energy to be transferred from one of the fixing rollers to the other and to eliminate the uneven temperature distribution. The preliminary rotation of the fixing rollers is stopped a predetermined time after the surface temperature of one of the fixing rollers has reached to a predetermined temperature.

13 Claims, 12 Drawing Sheets

TONER IMAGE FIXING DEVICE

BACKGROUND OF THE INVENTION

1. Field of the Invention

The present invention relates to a toner image fixing device having a heat roller for heat-fixing a toner image on a recording medium, intended for use as the fixing unit of an electrophotographic copying machine or the like.

2. Description of the Prior Art

In a toner image fixing device for heat-fixing a toner image on a recording medium with a pair of fixing rollers, the fixing roller or rollers are provided internally with a heater or heaters for heating the fixing roller, and the heater is regulated to maintain the temperature of the surface of the fixing roller at a predetermined temperature.

Before the start of the copying operation, warming-up time is necessary to heat the fixing roller or rollers to a predetermined surface temperature.

In such fixing device, if both fixing rollers are kept stopping during the warming-up time, the surface temperature distribution on the fixing roller is uneven, further when only one of the pair of fixing rollers is provided with a heater, only a portion of the other fixing roller in contact with the former fixing roller is heated while the surface temperature of the rest of the portions of the other fixing roller remains at the room temperature. Therefore, both the fixing rollers need to be rotated during the warming-up time to heat the fixing rollers uniformly. Various methods and means for efficiently heating fixing rollers to a predetermined surface temperature prior to fixing operation have been proposed.

FIG. 6 is a typical graph showing the variation of the respective surface temperatures of a pair of fixing rollers with time when the fixing rollers were rotated during the warming-up. As apparent from FIG. 6, a considerable warming-up is necessary before starting fixing operation. The surface of the upper fixing roller is heated up to a set temperature $T_1$ at a time $t_1$ and is ready for fixing operation. After the surface of the upper fixing roller has been heated up to the set temperature, the main motor is stopped to stop the rotation of the fixing rollers. However, when the fixing rollers are rotated from the beginning of the warming-up, heat energy is radiated at a high rate from the surface of the fixing rollers and thereby the warming-up time is extended, power consumption is increased accordingly, the fixing rollers are worn unnecessarily and noise is generated.

SUMMARY OF THE INVENTION

Accordingly, a principal object of the present invention is to solve the problems in the conventional toner image fixing devices and to provide a toner image fixing device capable of efficiently and uniformly heating the fixing rollers thereof in a short time.

Another object of the present invention is to provide a toner image fixing device capable of reducing the heat energy radiation of the fixing rollers thereof so that the surfaces of the fixing rollers are heated up to a predetermined temperature in a short time.

To achieve the object of the invention, the present invention provides a toner image fixing device comprising: a first roller having a heat source, a second roller pressed against the first roller to press a toner image on the recording sheet against the first roller to fix the toner image on the recording sheet; driving means for rotatively driving the first and second rollers; temperature difference detecting means for detecting the temperature difference between the first and second rollers, the temperature difference detecting means comprising temperature detecting means for detecting the temperature of the first roller, temperature detecting means for detecting the temperature of the second roller, difference detecting means for detecting the temperature difference between the first and second rollers from the temperatures detected by the temperature detecting means, respectively; and control means for controlling the driving means so as to actuate the driving means for driving the first and second rollers when the temperature difference between the first and second rollers reaches to the predetermined temperature difference, the control means comprising stopping means for stopping the first and second rollers on the basis of the temperature detected by the temperature detecting means for detecting the temperature of the first roller. cl

DESCRIPTION OF THE PREFERRED EMBODIMENTS

Figure 1:
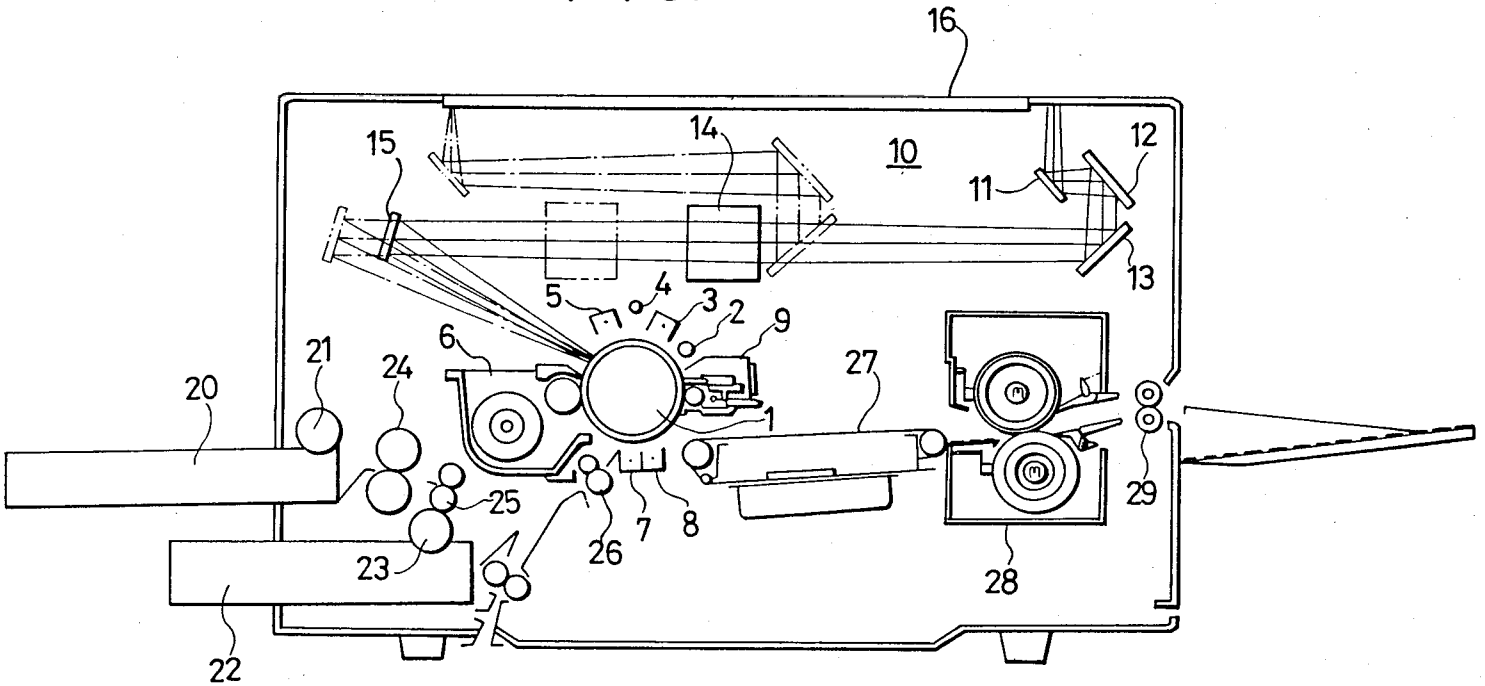
FIG. 1 is a sectional view of an electrophotographic copying machine employing a toner image fixing device, in a preferred embodiment, according to the present invention.

Referring to FIG. 1, there is shown an example of an electrophotographic copying machine incorporating a toner image fixing device, in a preferred embodiment, according to the present invention. The electrophotographic copying machine has a photosensitive drum 1 disposed substantially in the central portion of the electrophotographic copying machine so as to be rotated counterclockwise, as viewed in FIG. 1. A main eraser lamp 2, an auxiliary corona charger 3, an auxiliary eraser lamp 4, a main corona charger 5, a developing device 6, a transfer charger 7, a sheet separating charger 8 and a blade-type cleaning device 9 are arranged around the photosensitive drum 1. The surface of the photosensitive drum 1 is covered with a photosensitive layer capable of being sensitized and charged by means of the eraser lamps 2 and 4, and the corona chargers 3 and 5. The photosensitive drum 1 is exposed to a light image of a document to be copied by an optical system 10.

The optical system 10 is disposed under an original platform 16, for scanning the document placed on the original platform 16. The optical system 10 comprises a light source, not shown, for illuminating the document, movable mirrors 11, 12 and 13, a projection lens 14 and a projection mirror 15. A DC motor, not shown, drives the light source and the movable mirror for scanning operation to the left in FIG. 1 at a speed corresponding to the circumferential speed v of the photosensitive drum 1, and drives the movable mirrors 12 and 13 to the left at a speed v/2n (n=copying magnification). The circumferential speed v of the photosensitive drum 1 is constant regardless of copying magnification. To change the copying magnification, the projection lens 14 is shifted along the optical axis and the projection mirror 15 is shifted accordingly. In the left-hand section of the copying machine, there are provided copy casettes 20 and 22 respectively under the copy paper feeding rollers 21 and 23. A copying paper conveying path is formed by pairs of rollers 24 and 25, a pair of timing rollers 26, a conveyor belt 27, a toner image fixing device 28 and a pair of discharge rollers 29.

Figure 2:
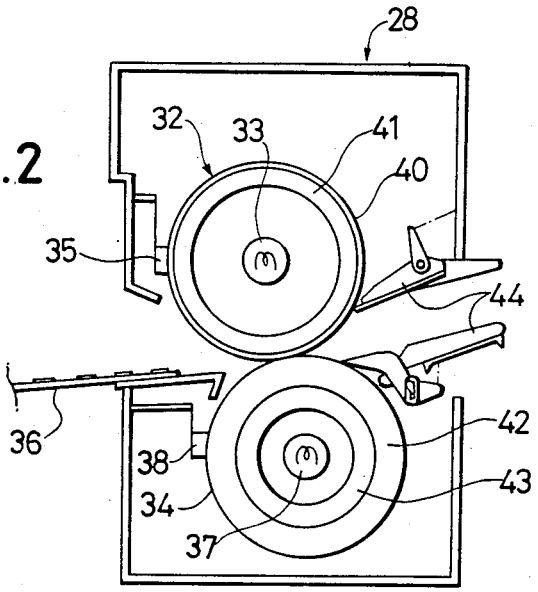
FIG. 2 is a sectional view showing the configuration of the toner image fixing device of FIG. 1.

FIG. 2 shows the toner image fixing device 28 embodying the present invention. Numeral 32 denotes an upper fixng roller, numeral 34 denotes a lower fixing roller, numeral 33 denotes an upper heater provided within a hollow formed in the core of the upper fixing roller 32 and numeral 37 denotes a lower heater provided within a hollow formed in the core of the lower fixing roller 34. The heating ability of the upper heater 33 is larger than that of the lower heater 37.

Numeral 35 denotes an upper thermistor for detecting the surface temperature of the upper fixing roller 32 and numeral 38 denotes a lower thermistor for detecting the surface temperature of the lower fixing roller 34.

Numeral 40 denotes covering materials formed by the Teflon (Trade name) or the like which covers the surface of the upper fixing roller 32 and numeral 41 denotes the core part formed by aluminum or the like.

Numeral 42 denotes covering materials formed by silicon rubber or the like which covers the surface of the lower fixing roller 34 and numeral 43 denotes the core part formed by aluminum or the like.

Numeral 36 denotes a guide member for guiding the copying sheet to the fixing device and 44 denotes separating fingers for separating the copying sheet from the fixing rollers.

Figure 3:
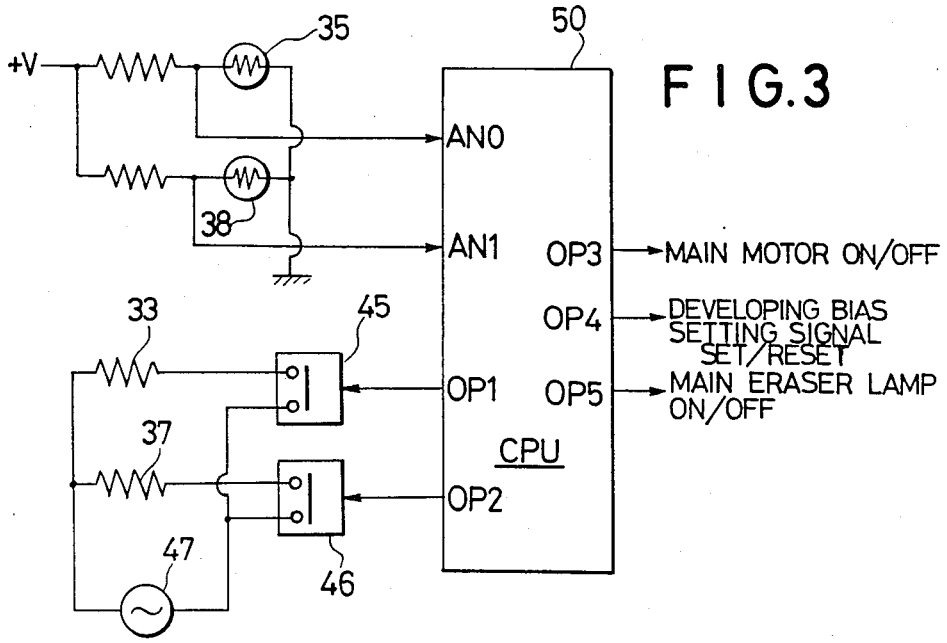
FIG. 3 is a block diagram of a temperature control circuit.

FIG. 3 shows a temperature control circuit for controlling the respective temperatures of the upper and lower fixing rollers 32 and 34. Numeral 50 denotes microprocessor for controlling the temperature of the fixing rollers 32 and 33 and for controlling the general operation of the electrophotographic copying machine. The microprocessor 50 has analog input ports AN0 and AN1, and output ports OP1, OP2, OP3, OP4 and OP5. Analog signals received through the analog input ports AN0 and AN1 are converted into digital signals by the AD converter provided in the microprocessor 50. The upper thermistor 35 and the lower thermistor 38 respectively for detecting the surface temperatures of the upper fixing roller 32 and the lower fixing roller 34 are connected to the input ports AN0 and AN1, respectively.

Control signals for controlling electromagnetic switches 45 and 46 for connecting the upper heater 33 and the lower heater 37 to and for disconnecting same from a power source 47 is provided through the output ports OP1 and OP2, respectively. A control signal for actuating a main motor, not shown, for driving the movable components of the copying machine including the upper and lower fixing rollers is provided through the output port OP3. A developing bias setting signal is provided through the output port OP4. A command signal for turning on and off the main eraser lamp 2 is provided through the output port OP5.

Although the microprocessor 50 controls other operations of the copying machine, the description thereof will be omitted since those operations are not related directly to the present invention.

The output signals in the form of the voltage from the thermistors 35 and 38 representing the surface temperatures of the fixing rollers are converted into temperature data by using a voltage-temperature conversion table stored in the memory of the microprocessor 50.

The mode of temperature control operation for controlling the surface temperatures of the upper fixing roller 32 and the lower fixing roller 34 will be described hereinafter with reference to FIGS. 2, 4 and 5. When the main switch of the copying machine is closed, electric power is supplied to the upper heater 33 and the lower heater 37 provided in the cores of the upper fixing roller 32 and the lower fixing roller 34, respectively, to heat the upper fixing roller 32 and the lower fixing roller 34. Since the heating ability of the upper heater 33 is larger than that of the lower heater 37, the surface temperature of the upper fixing roller 32 rises more rapidly than that of the lower fixing roller 34. The respective surface temperatures of the upper fixing roller 32 and the lower fixing roller 34 are detected by the thermistors 35 and 38, respectively. When the temperature difference between the respective surface temperatures of the upper fixing roller 32 and the lower fixing roller 34 reaches to a predetermined value $\Delta T1$, for example, 140° C., at time $t_2$, the main motor is actuated to drive the upper fixing roller 32 and the lower fixing roller 34 for preliminary rotation prior to copying operation. Then, part of the heat energy of the upper fixing roller 32 is transferred to the lower fixing roller 34 and hence the temperature rise rate of the upper fixing roller 32 decreases while the temperature rise rate of the lower fixing roller 34 increases, and uneven surface temperature distribution of the both fixing rollers 32 and 34 is eliminated.

Figure 4:
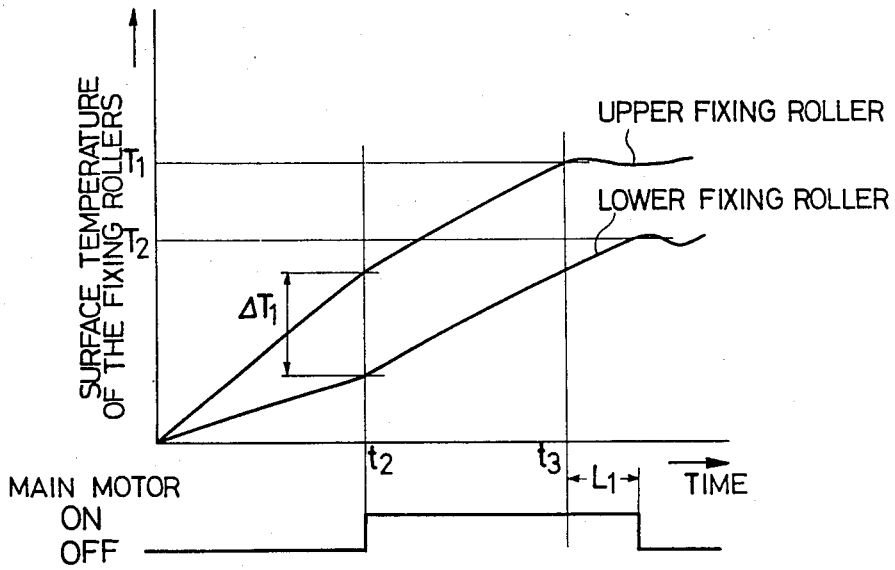
FIG. 4 is a graph showing the variation of the respective surface temperatures of the fixing rollers of the toner image fixing device of FIG. 1 with time.

When the surface temperature of the upper fixing roller 32 reaches to a target temperature $T_1$, for example, 190° C., at time $t_3$, as shown in FIG. 4, temperature control operation is started to maintain the surface temperature of the upper fixing roller 32 at the target temperature. The preliminary rotation of the fixing rollers 32 and 34 is continued for a predetermined time $L_1$, for example, 30 sec, after the surface temperature of the upper fixing roller 32 has reached to the target temperature $T_1$ to accelerate the temperature rise of the surface of the lower fixing roller 34. When the surface temperature of the lower fixing roller 34 reaches to a target temperature $T_2$, for example, 140° C., as shown in FIG. 4, temperature control operation is started to maintain the surface temperature of the lower fixing roller 34 at the target temperature $T_2$.

The upper heater 33 and the lower heater 37 are controlled by an ON-OFF control mode, in which the respective surface temperatures of the upper fixing roller 32 and the lower fixing roller 34 are detected by the thermistors 35 and 38, respectively, and the heaters are turned on when the surface temperature drops below the target temperature, while the heaters are turned off when the surface temperature rises above the target temperature. The ON-state and the OFF-state of the heaters are maintained for a predetermined time, for example, 3 sec, to avoid excessively frequent ON-OFF control operation.

Figure 5:
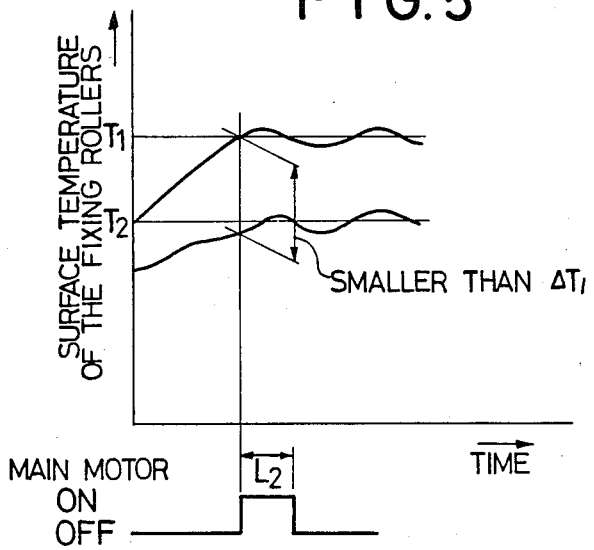
FIG. 5 is a graph showing the variation of the respective surface temperatures of the fixing rollers of the same toner image fixing device with time when the fixing rollers are warmed up.

Referring to FIG. 5, in case the surface temperature of the upper fixing roller has reached to the target temperature $T_1$ before the temperature difference between the upper fixing roller 32 and the lower fixing roller reaches to the predetermined value $\Delta T1$, the preliminary rotation is continued for a second predetermined time $L_2$, for example, 7 sec, which is shorter than the predetermined time $L_1$ only for eliminating the uneven surface temperature distribution on the fixing rollers 32 and 34. Such a case occurs when the copying machine is restarted soon after the end of the previous copying operation and the fixing rollers 32 and 34 are considerably warm. The temperature control operation to maintain the surface temperature of the upper roller and lower roller is carried out as same as in the case shown in FIG. 4.

When the main motor is actuated for the preliminary rotation of the fixing rollers 32 and 34, the photosensitive drum 1 is rotated, the developing bias setting signal is provided, and the transfer charger 7 and the main eraser lamp 2 are turned on to erase unnecessary charges on the photosensitive drum 1. When the preliminary rotation of the fixing rollers 32 and 34 is terminated, the photosensitive drum 1 is stopped and the transfer charger 7 and the main eraser lamp 2 are turned off sequentially to complete the preparatory operation of the copying machine.

In case of the breakage of the heating element of the lower heater 37 or the thermistor 38, the temperature difference between the upper fixing roller 32 and the lower fixing roller 34 exceeds a predetermined value $\Delta T2$ larger than the value $\Delta T1$. In such a case, the copying machine is stopped immediately and a trouble indication is given.

The temperature control operation of the microprocessor 50 will be described in detail hereinafter with reference to FIGS. 7 to 11.

Figure 7:
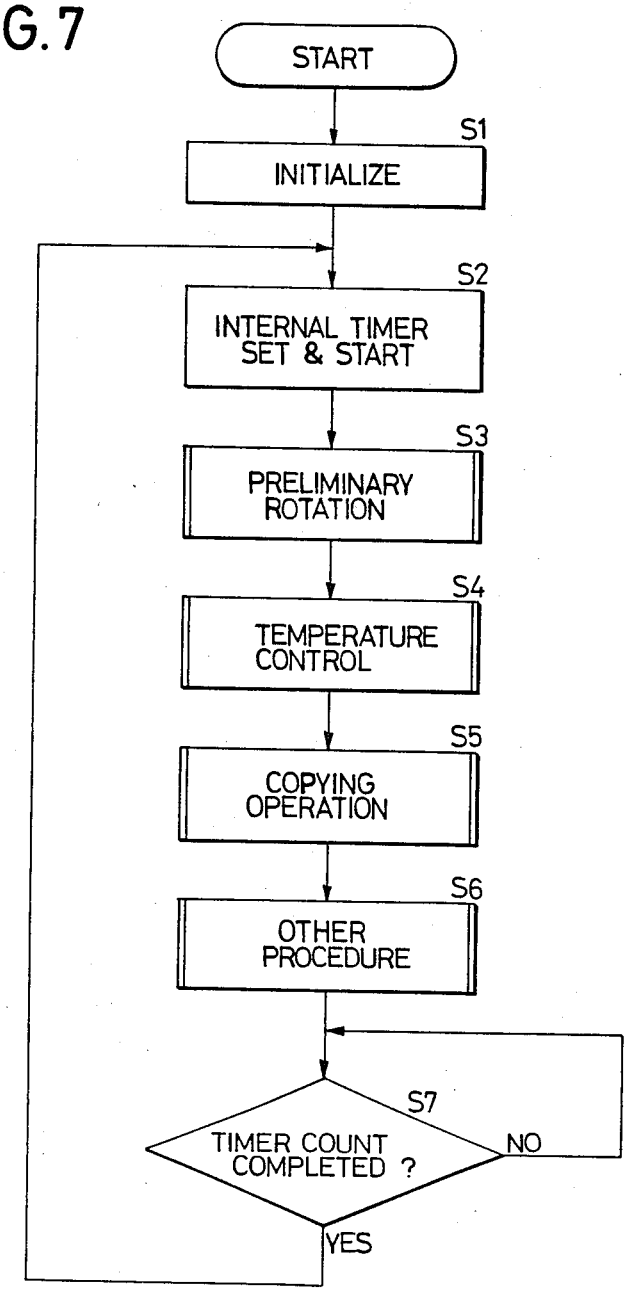
FIG. 7 is a flow chart of a main temperature control routine to be executed by a microprocessor.

Referring to FIG. 7 showing the main routine of the temperature control operation, the memories and registers are initialized at step S1. The internal timer of the microprocessor 50 is set and started at step S2. The preliminary rotation is started to heat the fixing rollers 32 and 34 for eliminating uneven temperature distribution and to erase unnecessary charges on the photosensitive drum 1 at step S3, which will be described in detail later with reference to FIG. 8.

Figure 9A:
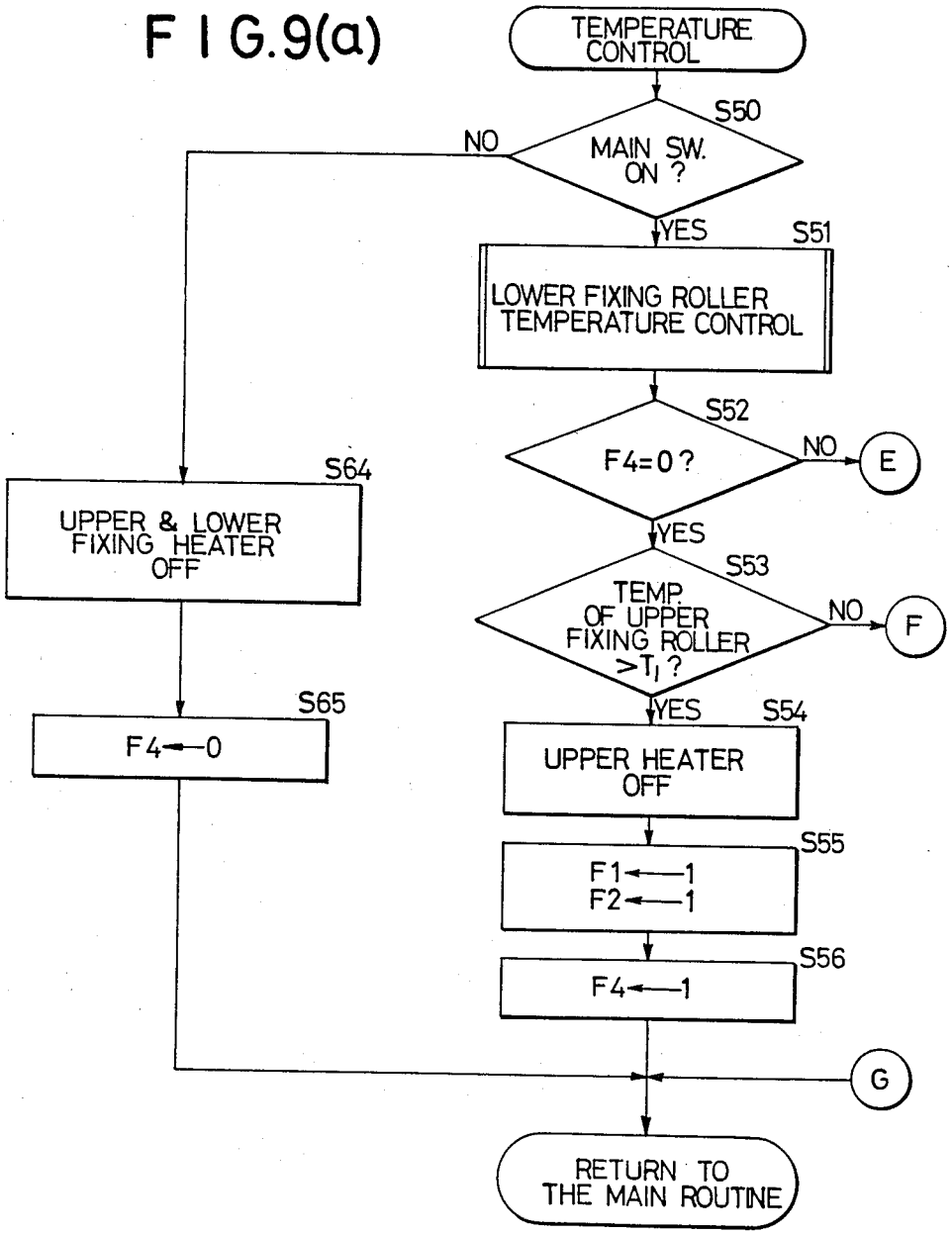
FIG. 9 is a flow chart of a subroutine for temperature control.
Figure 9B:
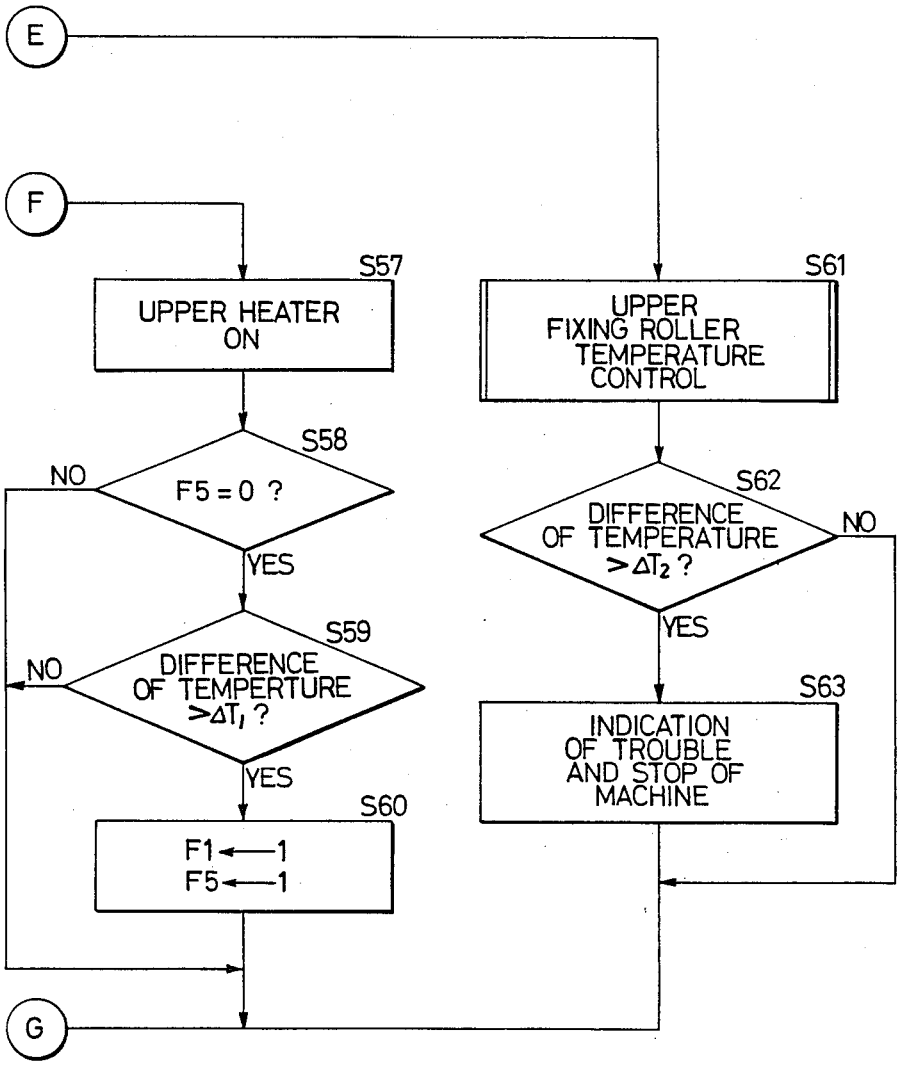

At step S4, temperature control operation for controlling the surface temperatures of the fixing rollers 32 and 34 is started, which will be described in detail later with reference to FIGS. 9, 10 and 11.

At step S5, copying operation is implemented. Other procedures, such as the processing of input data from key switches, are executed at step S6, the description of which will be omitted because those procedures are not related directly to the present invention.

At step S7, a decision is made as to whether or not a time count by the timer has completed, and when the decision is YES, the routine returns to step S2 to start the next cycle.

Figure 6:
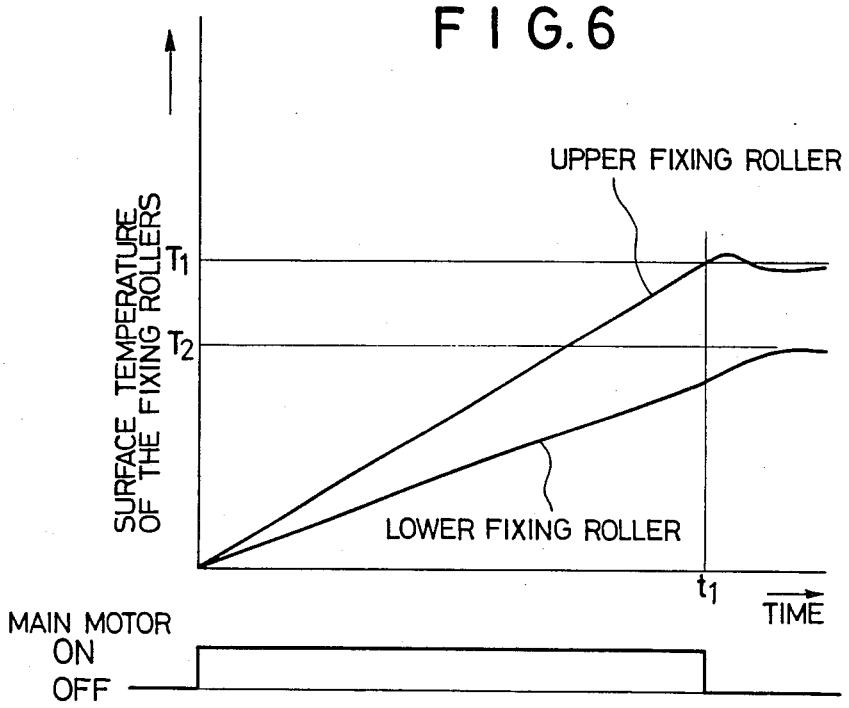
FIG. 6 is a graph showing the variation of the respective surface temperatures of the fixing rollers of a conventional toner image fixing device with time.
Figure 8A:
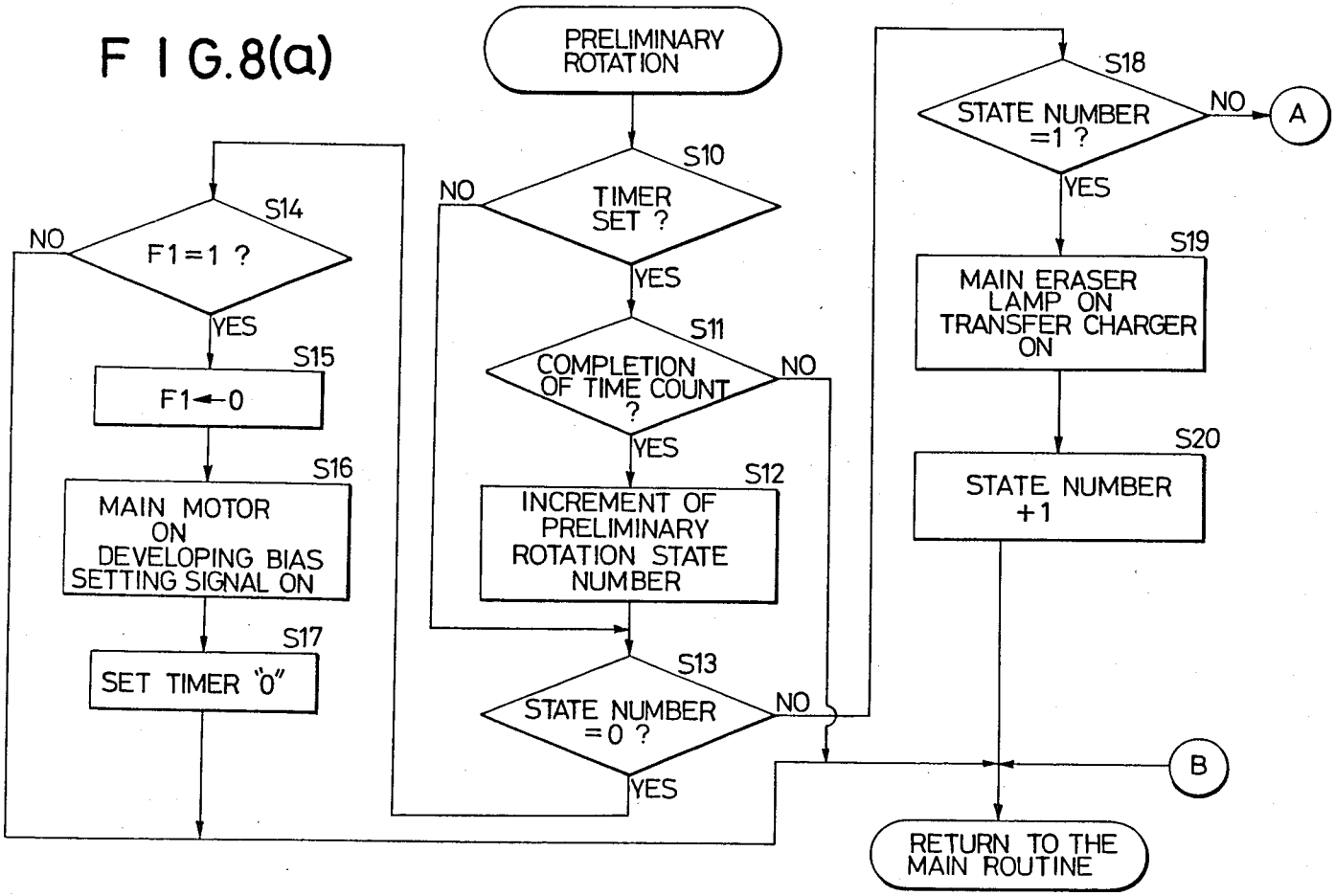
FIG. 8 is a flow chart of subroutine for preliminary rotation.
Figure 8B:
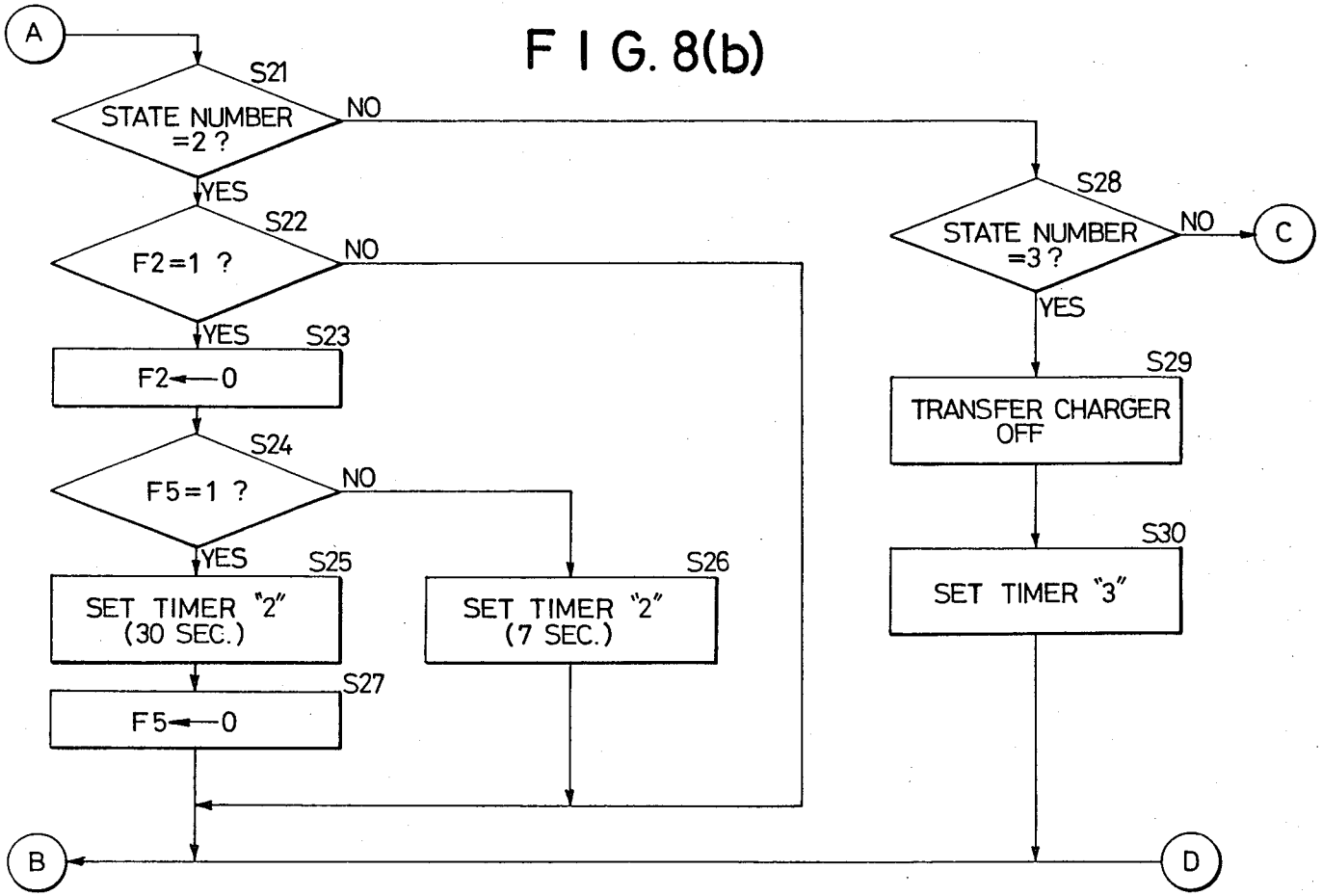
Figure 8C:
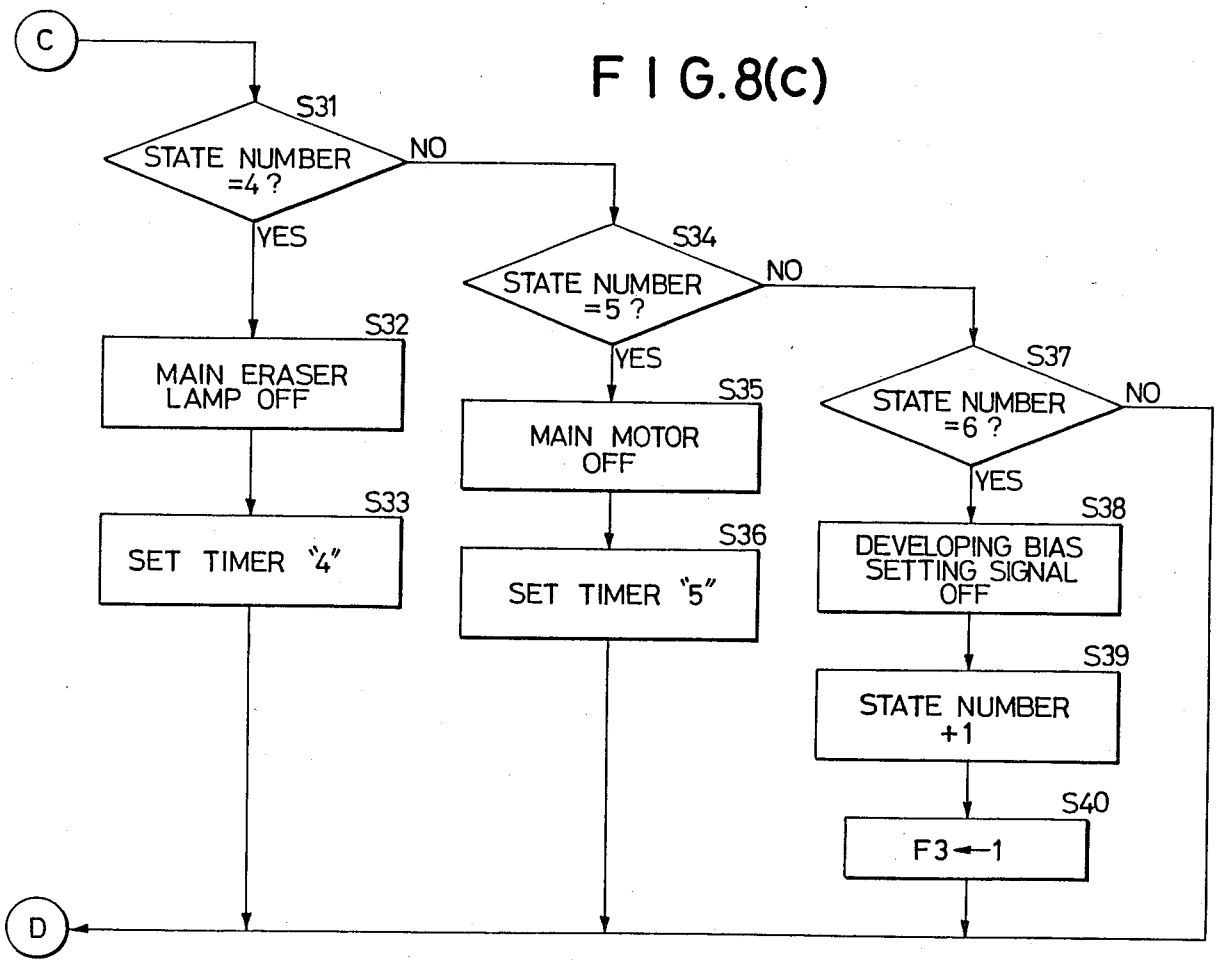

The preliminary rotation control subroutine shown at step S4 of the main routine will be described hereinafter with reference to the flow chart of FIG. 8. First, a decision is made at step S10 as to whether or not any one of five timers, namely, a timer 0, a timer 2, a timer 3, a timer 4 and a timer 5, for the preliminary rotation is set. The two or more timers among those five timers are never set simultaneously. At step S11, a decision is made as to whether or not the time count by the set timer has completed. When the decision at step S11 is NO, the routine is returned to the main routine. When the decision at step S11 is YES, an increment is made by adding one to a preliminary rotation state number indicating the sequence of processes at step S12. When the decision at step S10 is NO, the routine transfers to step S13, where the state number is examined. As mentioned in the flow chart of FIG. 6, since the control circuit is initialized at step S1 immediately after the main switch has been closed, the state number is "0" and the routine goes to step S14. A photosensitive drum preliminary rotation permission flag F1 set in a temperature control routine, which will be described later, is examined at step S14. When the flag $F1=1$, namely, the preliminary rotation of the photosensitive drum is permitted, the flag F1 is reset to "0" at step S15, and then the main motor is actuated and the developing bias setting signal is issued at step S16, and the timer 0 is set at step S17. The timer 0 is a delay timer to keep the time in which the rotating speed of the main motor rises to the normal rotating speed. After the timer 0 has been set, the routine is returned to the main routine. In the next cycle, a decision is made at step S11 as to whether or not the time count by the timer has completed. When the decision at step S11 is YES, the routine goes to step S12, where an increment is made by adding one to the state number, and then the routine goes via step S13 to step S18.

When the decision at step S14 is $F1 \neq 1$, namely, when the preliminary rotation is not permitted, the routine is returned to the main routine.

At step S18, the state number is examined and, when the state number is "1, the routine goes to step S19, where the main eraser lamp and the transfer charger are turned on, then an increment is made by adding one to the state number at step S20 to increase the state number to "2", and then the routine is returned to the main routine.

At step S21, the state number is examined and, when the state number is "2", the routine goes to step S22, where a flag F2 which is set upon the reaching of the surface temperature of the upper fixing roller 32 to the target value in the temperature control subroutine, which will be described later, is examined. When $F2=1$, namely, when the surface temperature of the upper fixing roller has reached to the target value, the flag F2 is reset to "0" at step S23, and then a flag F5 which is set upon the increase of the temperature difference between the upper fixing roller 32 and the lower fixing roller 34 to the predetermined value $\Delta T1$, for example, 140° C., is examined at step S24. When $F5=1$, namely, when the temperature difference is larger than the predetermined value $\Delta T1$, a first time $L_1$, for example, 30 sec, is set for the timer 2 at step S25 to extend the duration of the preliminary rotation by the time $L_1$ so that the lower fixing roller 34 which has not yet been heated sufficiently is heated by the upper fixing roller for eliminating uneven surface temperature distribution, and then reset the flag F5 to "0" at step S27 and the routine is returned to the main routine.

When F5≠1, namely, when the temperature difference between the upper fixing roller 32 and the lower fixing roller 34 is smaller than the predetermined value ΔT1 and the lower fixing roller is heated sufficiently, the routine goes to step S26, where the timer 2 is set for a second time $L_2$, for example, 7 sec, which is shorter than the first time $L_1$, simply for eliminating uneven surface temperature distribution, and then the routine is returned to the main routine.

At step S28, the state number is examined and, when the state number is "3", the routine goes to step S29, where the transfer charger is turned off, then the timer 3 is set for a time corresponding to the duration of rotation of the photosensitive drum necessary for erasing the unnecessary charges on the photosensitive drum at step S30, and then the routine is returned to the main routine.

At step S31, the state number is examined. When the state number is "4", the routine goes to step S32 and turned off the main eraser lamp, then the timer 4 is set for a time necessary for stopping the function of the main eraser at step S33, and then the routine is returned to the main routine.

At step S34, the state number is examined. When the state number is "5", the routine goes to step S34 and turned off the switch of the main motor, then the timer 5 is set for a time necessary for stopping the main motor at step S36, and then the routine is returned to the main routine.

At step S37, the state number is examined. When the state number is "6", the routine goes to step S38 to turn off the developing bias setting signal, then increment is made by adding one to the state number at step S39 to increase the state number to "7", and then a preliminary rotation end flag F3 is set at step S40.

After the preliminary rotation has been completed, any step of the preliminary rotation subroutine is not executed.

The temperature control subroutine shown at step S4 of the main routine will be described in detail hereinafter with reference to the flow chart of FIG. 9.

At step S50, a decision is made as to whether or not the main switch is ON. When the main switch is ON, temperature control operation for controlling the lower fixing roller 34 is executed at step S51, which will be described in detail afterward.

At step S52, the status of a flag F4 which is set when the surface temperature of the upper fixing roller 32 reaches to the target temperature $T_1$ is examined. When F4=0, namely, when the surface temperature of the upper fixing roller 32 does not reach to the target temperature, the routine goes to step S53, where a decision is made as to whether the surface temperature of the upper fixing roller 32 is higher than the target temperature $T_1$ or not. When the surface temperature of the upper fixing roller 32 is higher than the target temperature $T_1$, the upper heater 33 is turned off at step S54, then the flags F1, F2 and F4 are set at steps S55 and S56, and then the routine is returned to the main routine. When the surface temperature of the upper fixing roller 32 is lower than the target temperature, the routine goes to step S57, where the upper heater 33 is turned on, and then the status of a flag F5 which indicates whether or not the surface temperature difference between the upper fixing roller 32 and the lower fixing roller 34 is the predetermined value ΔT1, for example, 140° C., is examined at step S58. When F5=0, a decision is made at step S59 as to whether or not the temperature difference is greater than the predetermined value ΔT1 and, when the decision at step S59 is YES, the flags F1 and F5 are set at step S60, and then the routine is returned to the main routine.

When the decision at step S58 is NO or when the decision at step S59 is NO, the routine is returned to the main routine. When the decision at step S52 is NO, namely, when the surface temperature of the upper fixing roller 32 reaches to the target temperature, the routine goes to step S61, where temperature control operation for the upper fixing roller 32 is started, which will be described afterward.

At step S62, a decision is made as to whether or not the surface temperature difference between the upper fixing roller 32 and the lower fixing roller 34 is as large as a value ΔT2 larger than the predetermined value ΔT1. When the decision at step S62 is YES, the routine goes to step S63 to indicate the state of trouble and to stop the copying machine.

When the decision at step S50 is NO which indicates the end of the copying operation, the routine goes to step S64, where the upper and lower heaters are turned off, then the flag F4 is reset to "0" at step S65, and then the routine is returned to the main routine.

The temperature control subroutines for controlling the surface temperature of the upper fixing roller 32 and the lower fixing roller 34 shown at step S51 and at step S61 in the flow chart of FIG. 9 will be described hereinafter. Since the temperature control subroutines for the upper fixing roller 32 and for the lower fixing roller 34 are substantially the same, only the temperature control subroutine for the upper fixing roller 32 will be described in detail with reference to FIG. 10 and the temperature control subroutine for the lower fixing roller 34 will be described briefly.

Figure 10:
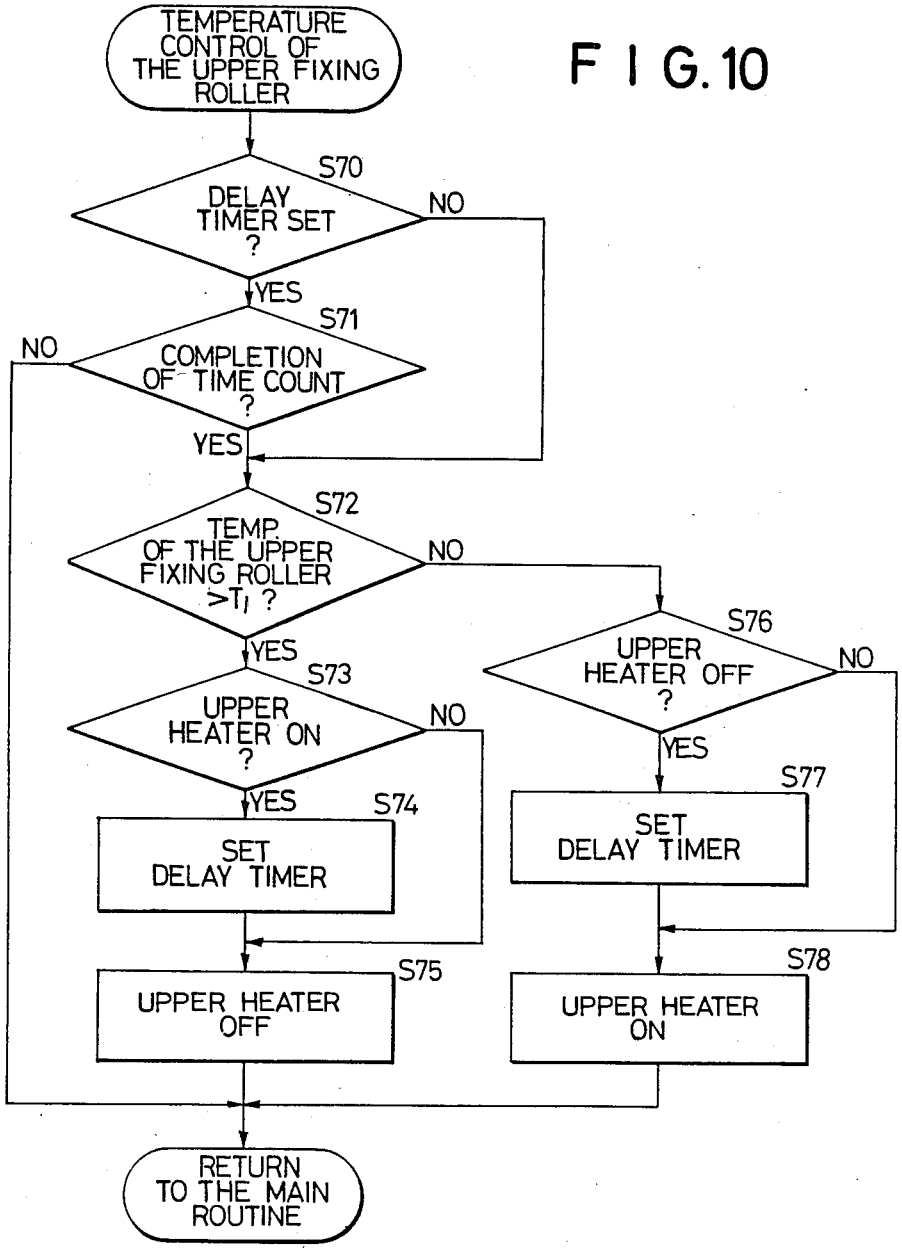
FIG. 10 is a flow chart of a subroutine for controlling the temperature of the upper fixing roller.

Referring to FIG. 10, a decision is made at step S70 as to whether or not the delay timer is set. The delay timer is provided for the hysteresis ON-OFF control of the upper heater 33 to continue the ON-state and the OFF-state of the upper heater 33 for a predetermined period of time, for example, 3 sec, so that the upper heater 33 will not be turned on and off excessively frequently. When the delay timer is set, a decision is made at step S71 as to whether or not the time count by the timer has completed. When the decision at step S71 is YES, a decision is made at step S72 as to whether or not the surface temperature of the upper fixing roller 32 is higher than the target temperature T1, for example, 190° C. When the decision at step S72 is YES, a decision is made at step S73 as to whether or not the upper heater 33 is turned on. When the decision at step S73 is YES, the delay timer is set at step S74, then the upper heater 33 is turned off at step S75, and then the routine is returned to the temperature control routine. When the decision at step S73 is NO, the routine goes to step S75.

When the decision at step S72 is NO, the routine goes to step S76, where a decision is made as to whether or not the upper heater 33 is turned off. When the decision at step S76 is YES, the delay timer is set at step S77, then the upper heater 33 is turned on at step S78, and then the routine is returned to the temperature control routine. When the decision at step S76 is NO, the routine goes to step S78.

When the decision at step S70 is NO, the routine goes to step S72, where a decision is made as to whether or not the surface temperature of the upper fixing roller 32 is higher than the target temperature $T_1$. When the decision at step S71 is NO, the routine is returned to the temperature control routine.

Figure 11:
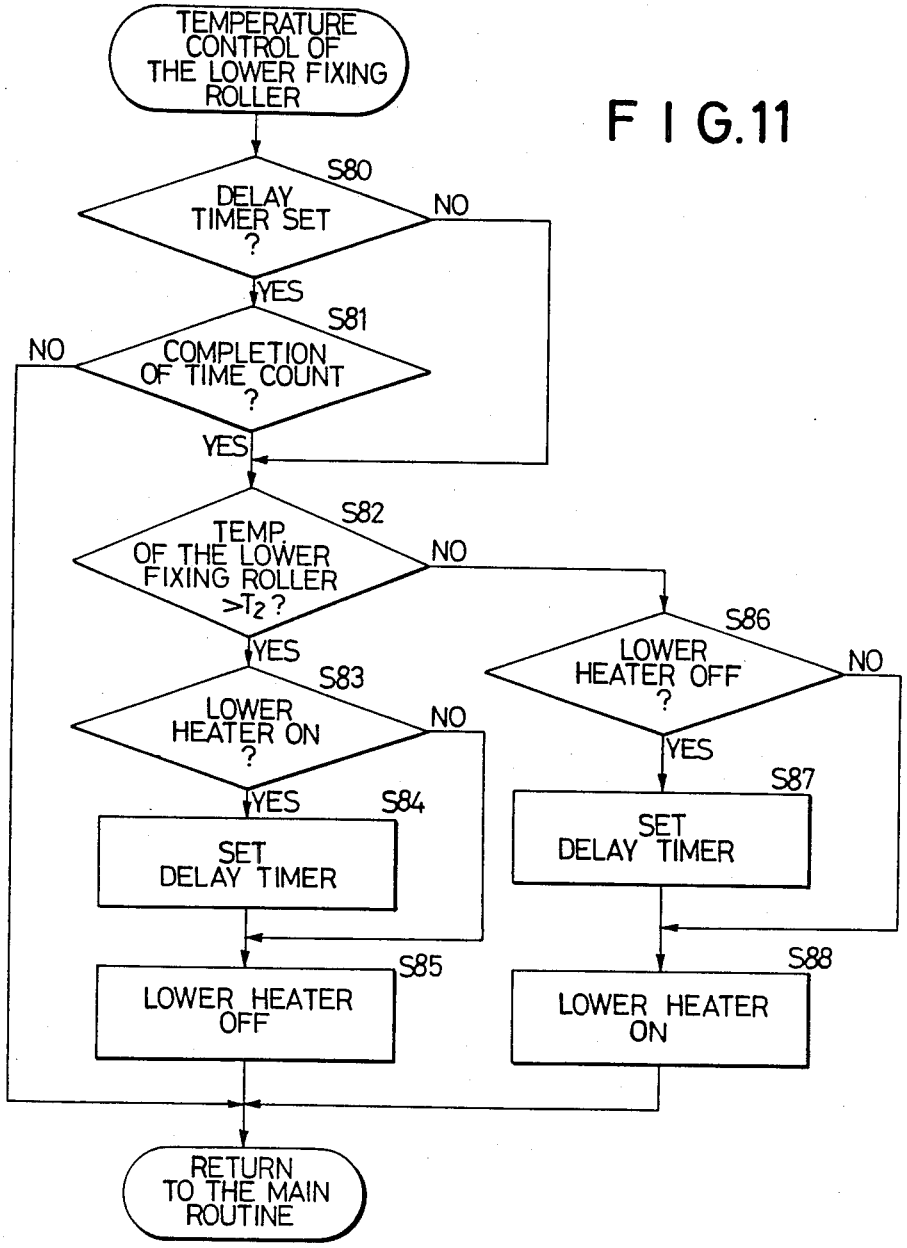
FIG. 11 is a flow chart of a subroutine for controlling the temperature of the lower fixing roller.

The temperature control subroutine for the lower fixing roller 34 shown in FIG. 11 is substantially the same as that for the upper fixing roller 32 except that the target value $T_2$, for example, 140° C., which is used as a creterion of decision at step S82 is lower than the target value $T_1$ for the surface temperature of the upper fixing roller 32.

Thus, according to the present invention, the preliminary rotation of the upper fixing roller and the lower fixing roller is started after the surface temperature difference between the upper fixing roller and the lower fixing roller has reached to a predetermined value for the following reasons.

At the start of the copying operation, the fixing rollers are cold when the copying machine is placed in an environment of a low temperature. As the ability of the lower heater for the lower fixing roller is smaller than that of the upper heater for the upper fixing roller, the rate of temperature rise of the lower fixing roller is lower than that of the upper fixing roller and the uneven surface temperature distribution on the lower fixing roller is larger than that of the upper fixing roller. Therefore, when the fixing rollers are cold, it is necessary to extend the duration of the preliminary rotation to increase the amount of heat energy transferred from the upper fixing roller to the lower fixing roller and to eliminate the uneven surface temperature distribution.

On the contrary, when the copying machine is placed in an environment of a not low temperature, both the fixing rollers are warm at the start of the copying operation and the surface temperature of the lower fixing roller rises comparatively rapidly and uniformly, and hence only a small amount of heat energy needs to be transferred from the upper fixing roller to the lower fixing roller and the duration of the preliminary rotation for eliminating uneven surface temperature distribution may be short.

The surface temperature difference between the upper and lower fixing rollers reaches to a predetermined value in a short time when fixing rollers are cold. Therefore, preliminary rotation is started in earlier time and it means the extension of the preliminary rotation. On the contrary, the surface temperature difference between the upper and lower fixing rollers reaches to a predetermined value rather long time after when fixing rollers are warm. Therefore, preliminary rotation is started in later time and it means the shortening of the preliminary rotation.

As apparent from the foregoing description, according to the present invention, when the copying machine is connected to the power source, the upper and lower fixing rollers are kept stationary and the preliminary rotation of the upper and lower fixing rollers is started after the surface temperature difference between the upper fixing roller and the lower fixing roller has reached to a predetermined value. Accordingly, the upper and lower fixing rollers are heated uniformly to the respective operating temperatures in a short time and hence the power consumption of the copying machine is reduced. Furthermore there is no possibility that the upper and lower fixing rollers are damaged by the locally solidified toner, and hence the life of the upper and lower fixing rollers is extended. Still further, since the upper and lower fixing rollers are not rotated uselessly, the copying machine generates less noise. In the preferred embodiment described herein, both the upper and lower fixing rollers are provided internally with heaters, respectively, however, only one of the upper and lower fixing rollers, either the upper fixing roller or the lower fixing roller, may be provided with an internal heater.

Although the invention has been described in its preferred form with a certain degree of particularity, it is to be understood to those skilled in the art that many changes and variations are possible in the invention without departing from the scope and spirit thereof.

What is claimed is:

1. A toner image fixing device comprising:
a first roller provided with heating means;
a second roller pressed against the first roller so as to fix a toner image carried on a recording sheet as the recording sheet is passed between the first and second rollers;
driving means for rotatively driving the first and second rollers;
temperature difference detecting means for detecting the temperature difference between the first and second rollers; and
control means which starts the preliminary rotation of the first and second rollers when the temperature difference between the first and second rollers reaches to a predetermined value after the heating means has been energized.

2. A toner image fixing device as claimed in claim 1, wherein said temperature difference detecting means comprises first temperature detecting means for detecting the temperature of said first roller and second temperature detecting means for detecting the temperature of said second roller, and detects the temperature difference between said first and second rollers on the basis of temperatures detected by the first and second temperature detecting means, respectively.

3. A toner image fixing device as claimed in claim 2, wherein said control means stops the preliminary rotation of said first and second rollers on the basis of temperature detected by said first temperature detecting means after the start of the preliminary rotation of said first and second rollers.

4. A toner image fixing device as claimed in claim 3, wherein said control means stops the preliminary rotation of said first and second rollers a predetermined time after the temperature of said first roller has reached to the predetermined temperature.

5. A toner image fixing device as claimed in claim 1, wherein said second roller is provided with heating means.

6. A toner image fixing device as claimed in claim 5, wherein the heating ability of the heating means of said second roller is smaller than that of the heating means of said first roller.

7. A toner image fixing device comprising:
a first roller provided with heating means;
a second roller pressed against the first roller so as to fix a toner image carried on a recording sheet as the recording sheet is passed between the first and second rollers;
driving means for rotatively driving the first and second rollers;
first temperature detecting means for detecting the temperature of the first roller;

second temperature detecting means for detecting the temperature of the second roller;

temperature difference detecting means for detecting the temperature difference between the first and second rollers on the basis of temperatures detected by the first and second temperature detecting means, respectively;

first control means which starts the preliminary rotation of the first and second rollers when the temperature difference between the first and second rollers reaches to a predetermined value after the heating means has been energized, and stops the preliminary rotation of the first and second rollers a first predetermined time after the temperature of the first roller has reached to the predetermined temperature;

second control means which starts the preliminary rotation of the first and second rollers when the temperature of the first roller reaches to the predetermined temperature after the heating means has been energized, and stops the preliminary rotation of the first and second rollers a second predetermined time after the start of the preliminary rotation of the first and second rollers; and selecting means for selecting either the first control means or the second control means.

8. A toner image fixing device as claimed in claim 7, wherein said selecting means selects said first control means when the temperature difference between said first and second rollers reaches to a predetermined value before the temperature of said first roller reaches to the predetermined temperature.

9. A toner image fixing device as claimed in claim 7, wherein said selecting means selects said second control means when the temperature of said first roller reaches to the predetermined temperature before the temperature difference between the first and second rollers reaches to the predetermined value.

10. A toner image fixing device as claimed in claim 7, wherein said first predetermined time is longer than said second predetermined time.

11. A toner image fixing device as claimed in claim 7, wherein said second roller is provided with heating means.

12. A toner image fixing device comprising:

a first roller provided with heating means;

a second roller pressed against the first roller so as to fix a toner image carried on a recording sheet as the recording sheet is passed between the first and second rollers;

driving means for rotatively driving the first and second rollers;

temperature difference detecting means for detecting the temperature difference between the first and second rollers; and control means which controls the rotation of the first and second rollers on the basis of the temperature difference detected by the temperature difference detecting means.

13. A toner image fixing device comprising:

a first roller provided with a first heating means;

a second roller provided with a second heating means having a heating ability smaller than that of the first heating means and pressed against the first roller so as to fix a toner image carried on a recording sheet as the recording sheet is passed between the first and second rollers;

temperature difference detecting means for detecting the temperature difference between the first and second rollers; and means for stopping the operation of the associated apparatus upon the increase of the temperature difference between the first and second rollers beyond a predetermined value.

* * * * *